US005893585A

United States Patent [19]

Worthen

[11] Patent Number: 5,893,585

[45] Date of Patent: Apr. 13, 1999

[54] EXPANDABLE BINDER

[76] Inventor: John E. Worthen, 4485 Abinadi Way, Salt Lake City, Utah 84124

[21] Appl. No.: 08/842,191

[22] Filed: Apr. 23, 1997

Related U.S. Application Data

[60] Provisional application No.60/016,014, Apr. 23, 1996.

[51] Int. Cl.[6] ..... B42D 3/00

[52] U.S. Cl. ..... 281/45; 229/62.3; 281/29

[58] Field of Search ..... 281/15.1, 21.1, 281/19.1, 29, 36, 45; 229/67.3; 493/947

[56] References Cited

U.S. PATENT DOCUMENTS

| | | | |
|---|---|---|---|
| 4,284,227 | 8/1981 | Corey | 229/67.3 |
| 4,790,474 | 12/1988 | Mitsuyama | 229/67.3 |
| 5,174,606 | 12/1992 | Hune | 281/45 |
| 5,433,481 | 7/1995 | Corbishley | 281/45 |

*Primary Examiner*—Willmon Fridie, Jr.
*Attorney, Agent, or Firm*—Trask, Britt & Rossa

[57] ABSTRACT

A binder cover with a spine or binding section which has a pleated expandable center section with a first folding section and a second folding section on either side and each connected to the binder cover. The first folding section and the second folding section define a channel to receive the documents to be contained within the binder. Fasteners, such as staples, are positionable through the first folding section and the second folding section to secure the documents therein. The fasteners may include, for example, staples, thread, cable, posts and screws, clamps or glue. Adhesive is available to secure the first folding section in its second or closed position and the second folding section in its second or closed position.

20 Claims, 4 Drawing Sheets

EXPANDABLE BINDER

This application claims the benefit of U.S. Provisional Application No. 60/016,014, filed Apr. 23, 1996.

BACKGROUND OF THE INVENTION

1. Field of the Invention

The invention relates to a binders or a cover system for securing and holding materials such as documents or an inner folder between covers and, more particularly, to a binder with an expandable portion for securing materials such as documents of a varying preselected thickness.

2. State of the Art

A wide variety of binders have been devised to receive documents which are secured therein by any desired fastening means, such as staples, screws and posts, brads, clips and the like. For example, a seminar presentation could include a small booklet with an outline and other presentation materials. The booklet could be formed by assembling the pages (documents) and securing them between protective covers selected for the purpose. In some applications, it is desired that access to the fastening means is to be restricted for esthetics or for other reasons.

FIG. 1 shows one form of prior art binder 10 having a front cover 14 and a back cover 16 joined by a center region 18 that extends the length of the front cover 14 from one end 17 to the other end 19. Center region 18 is comprised of sections 22, 24, 26, and 28, which extend between the ends 17 and 19. A first crease 34 is formed between the front cover 14 and the section 22. A second crease 36 is formed between sections 22 and 24. A third crease 38 is formed between sections 24 and 26. A fourth crease 40 is formed between sections 26 and 28. A fifth crease 42 is also formed between back cover 16 and section 28. Because of the perspective view of the binder 10 in FIG. 1, only very small portions of section 22 and section 26 are shown. Documents of just about any kind or description including, for example, newspaper material, magazines, computer print outs and traditional eight by ten paper may be positioned in various assemblies in a groove 46 defined by sections 24 and 26. The documents may be fastened into the groove by, for example, staples that are positioned through sections 24 and 26 as well as the documents in the groove 46. The front cover 14 and the rear cover 16 are moved to expose the sections 24 and 26. That is, for example, a stapler (not shown) may be inserted in a groove 50 created by sections 22 and 24, while the other side of the stapler may be inserted in a groove 52 formed by sections 26 and 28. Thereafter, the stapler may be operated to secure the documents or whatever in the groove 46.

An adhesive 58 (shown as dots) is applied to section 28. Adhesive 58 may be covered with a piece of protective coating to keep it from sticking until the binder 10 is ready for assembly with documents or whatever. Once the tape is removed, adhesive 58 is used to adhere section 26 to section 28. An adhesive (not shown) is also applied to section 22. The adhesive may be covered with a piece of tape to keep it from sticking. Once the tape is removed, the adhesive is used to adhere section 22 to section 24.

With section 22 adhered to section 24 and section 26 adhered to section 28, staples that hold documents in groove 46 are not visible.

A disadvantage of binder 10, however, is that it can only hold documents having a thickness 47 that is limited. That is, documents having a thickness of, for example, one half an inch, should often be difficult to assemble. There is, therefore, a need for a binder with the features of binder 10, but that can hold documents or other objects of substantial thickness as well as documents over a wide range of thicknesses.

BRIEF SUMMARY OF THE INVENTION

The present invention relates to a binder having a first folding section connected to the first edge of a front cover. The first folding section extends inwardly from the first edge and is operable between a first position in which it is open for receiving first fastening means for fastening documents to the first folding section and a second position spaced from the first position and configured to limit or restrict visual access to the first fastening means. Preferably the first folding section has a first section and a second section which are a fold surface and a fastening surface.

First securing means is associated with the first folding section for securing the first folding section in its second position. The securing means is preferably an adhesive. The documents and the first and second sections may be connected through, for example, staples, thread, cable, or glue.

A second folding section is attached to a second cover along a first edge. The second folding section has a portion extending inwardly from the second edge. The second folding section is operable between a first position in which it is open for receiving fastening means including the fastening means extending from the first folding section and a second position in which the visual access to the second fastening means is impaired. Second securing means is associated with the second folding section for securing the second folding section in its second position.

An expandable section is connected to and between the first folding section and the second folding section. The expandable section is spaced from the first folding section and the second folding section to define a channel therebetween to receive documents therein. The expandable section is operable to extend between a collapsed condition for receiving a first selected quantity of documents and an expanded condition for receiving a second selected quantity of documents. The second selected quantity is larger than the first selected quantity.

In a preferred arrangement, the first folding section has a first crease and first fold surface extending from the first edge to the first crease and first fastening surface which extends from the first crease to the expandable section. Similarly, the second folding section has a second fold surface extending from the second edge to the second crease and a second fastening surface extending from the second crease to the expandable section.

In a more preferred configuration, the first securing means and the second securing means are a first adhesive and a second adhesive, respectively. The first adhesive and the second adhesive are desirably of the type that are first applied to the substrate and then protected or covered with a non-woven material. To use the adhesive, the protective covering is removed so that the adhesive is now ready for contact and to execute its function. Alternatively, the adhesive may be of the type that is heat activated and may be a heat transfer material.

In alternative configurations, the covers are formed to contain therewith documents or other materials. The fastening means may include staples, string, staples and even posts and screws positioned through apertures formed in the first fastening surface, the second fastening surface and the documents in the channel.

The expandable section may preferably be formed of a non-woven material and may be formed into a plurality of pleats or folds. The pleats or folds have creases that extend generally in alignment with the first edge and the second edge. Desirably, the first edge and the second edge are each substantially straight.

The interior of the expandable section may have an adhesive positioned on all or on select portions thereto to attach and retain documents thereto as part of the first securing means and the second securing means.

In yet another and preferable alternative, the first folding section and the second folding section are each formed to be "V"-shaped in cross section.

The first folding section and the second folding section each may be part of a continuous piece of material such as cloth, plastic, paper, metal, or the like. Alternatively, the first folding section and the second folding section may be separate pieces of material, but joined. The channel is expandable and may be a continuous piece of material or may be separate pieces of material adhered between the first and second sections.

Under one embodiment, the expandable section is made of a non-woven material formed into pleats or folds much like an accordion. In an alternative embodiment, the expandable section is made of a material having elastic characteristics. Other variations are within the scope of the invention. The expandable section may be of the same or different material than the rest of the binder. The expandable section may be one continuous piece with the rest of the binder or may be a separate piece and/or a separate type of material.

Various portions of the binder, including the center portion or expandable portion, may be reinforced with metal or other hard objects. The various pieces of the binder may include a variety of materials including paper, cloth, plastic, metal, or fabric. The front and rear covers can be made in multiple sizes or pieces attached to but sliding and/or opening upon itself (like a sliding door to expand the width) from cloth, extruded plastic, plastic, fabric, paper or similar material to accommodate the center of the book jacket and have adhesive or other means to connect it with the front and/or back of the covers.

There may be flaps or see-through portions of the back sections to accommodate structural slats and/or printed material to reinforce the binder and/or identify the bound documents, objects, or other products.

Examples of the documents and things which may be bound using the binder include newspapers, sheet paper, transparencies, photos and magazines.

A preferred method of use is also disclosed.

BRIEF DESCRIPTION OF THE SEVERAL VIEWS OF THE DRAWING

In the drawings which illustrate what is presently regarded as the best modes for carrying out the invention.

DETAILED DESCRIPTION OF THE INVENTION

Figure 1:
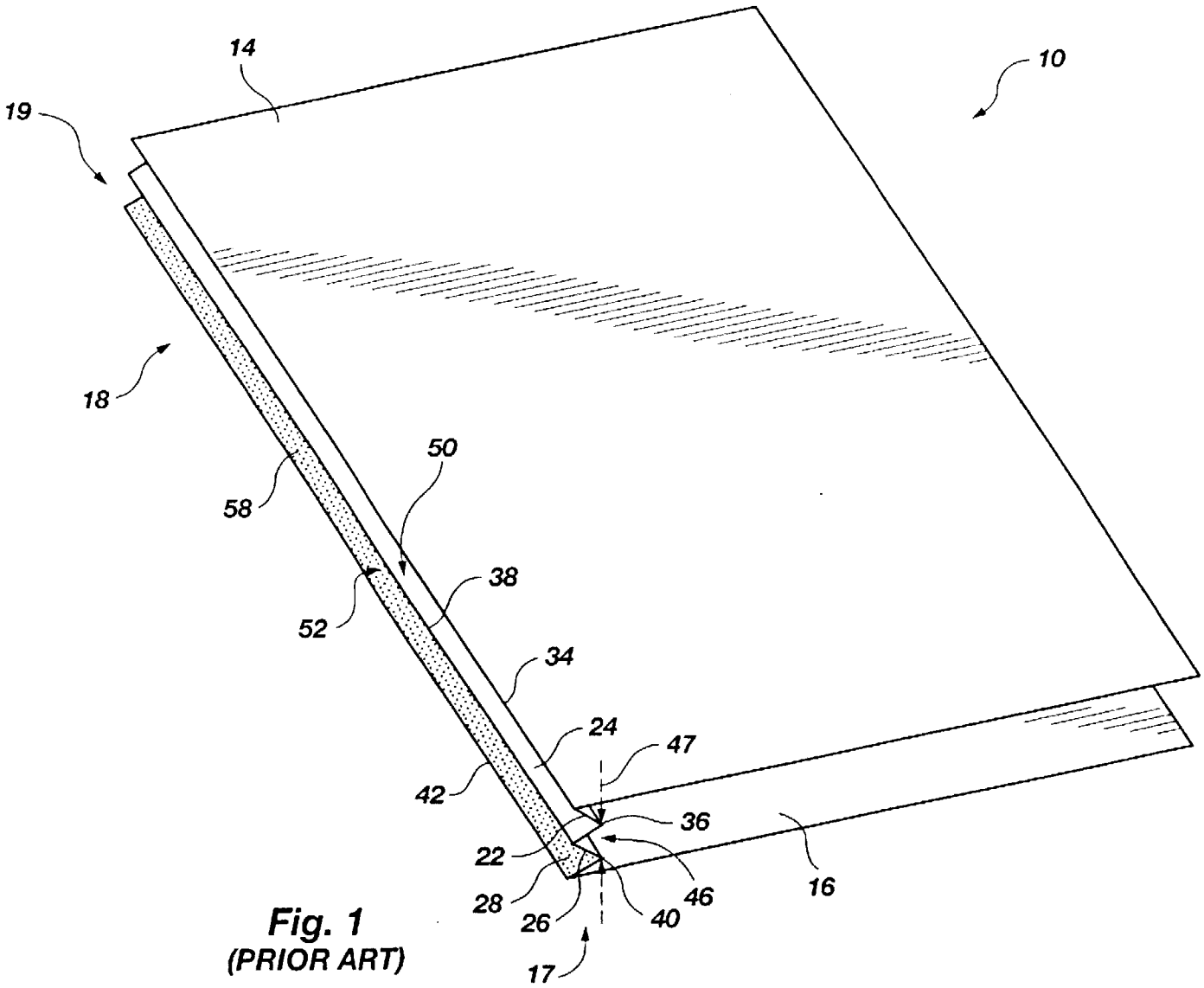
Fig. 1 (PRIOR ART)
FIG. 1 is a perspective view of a prior art binder.
Figure 2:
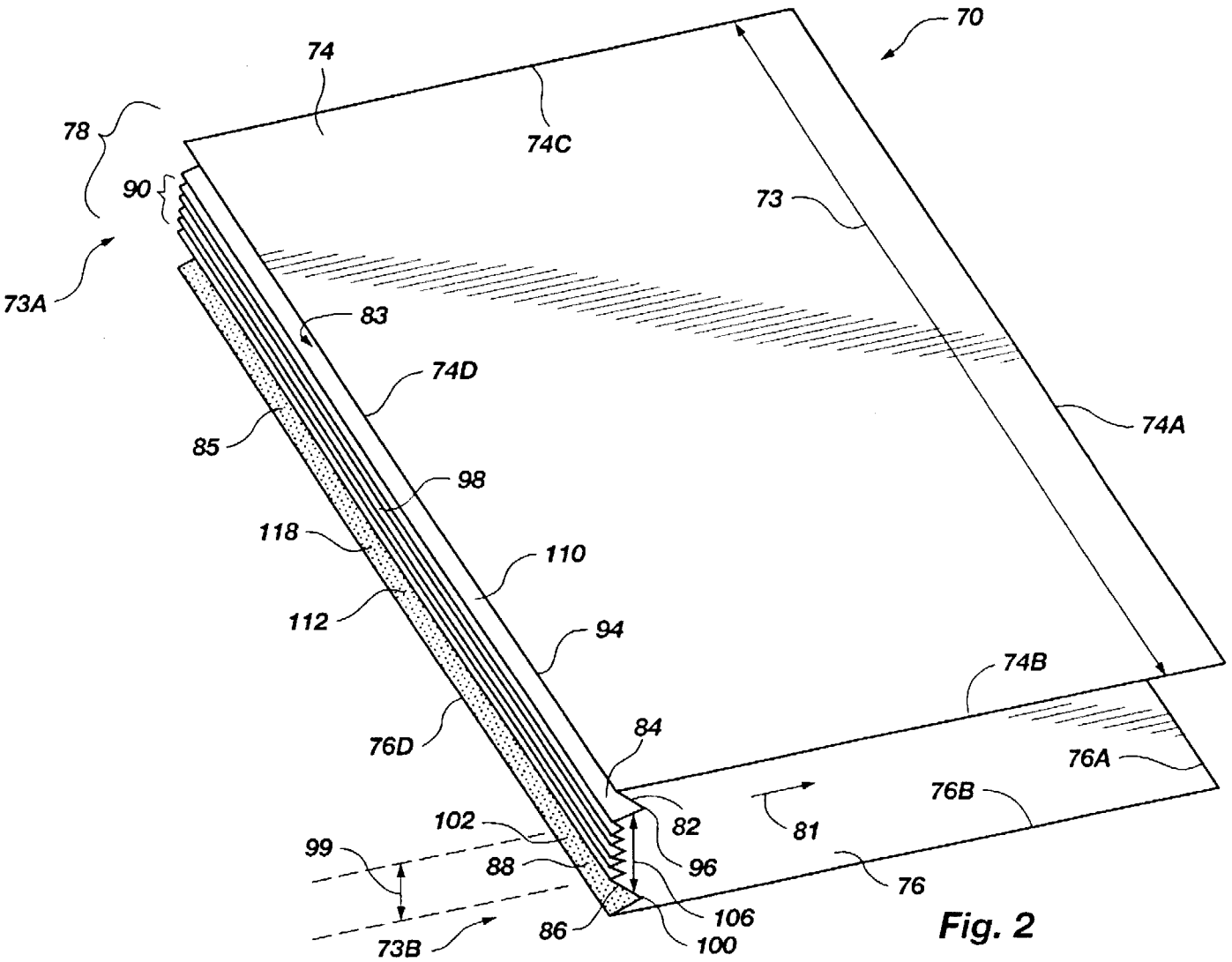
FIG. 2 shows a binder of the present invention in perspective before joining documents thereto.

FIG. 2 shows a binder 70 having a front cover 74 and a back cover 76. The front cover 74 is here shown to be generally rectangular in projection with edges 74A, 74B, 74C and 74D. The back cover 76 is similarly shaped with edges 76A, 76B and 76D. One edge of the back cover 76 is obscured in the illustration. Although the front cover 74 and back cover 76 are here shown to be generally rectangular in projection, it should be understood that the front cover 74 and the back cover 76 may be of any shape desired.

Front cover 74 and back cover 76 are joined by a center region 78 that extends therebetween along the length 73 of front cover 74 from one end 73A to the other end 73B. Center region 78 is comprised of sections 82, 84, 86, and 88 that are formed into a first folding section 83 and a second folding section 85. The center region also has an expandable section 90.

Figure 3:
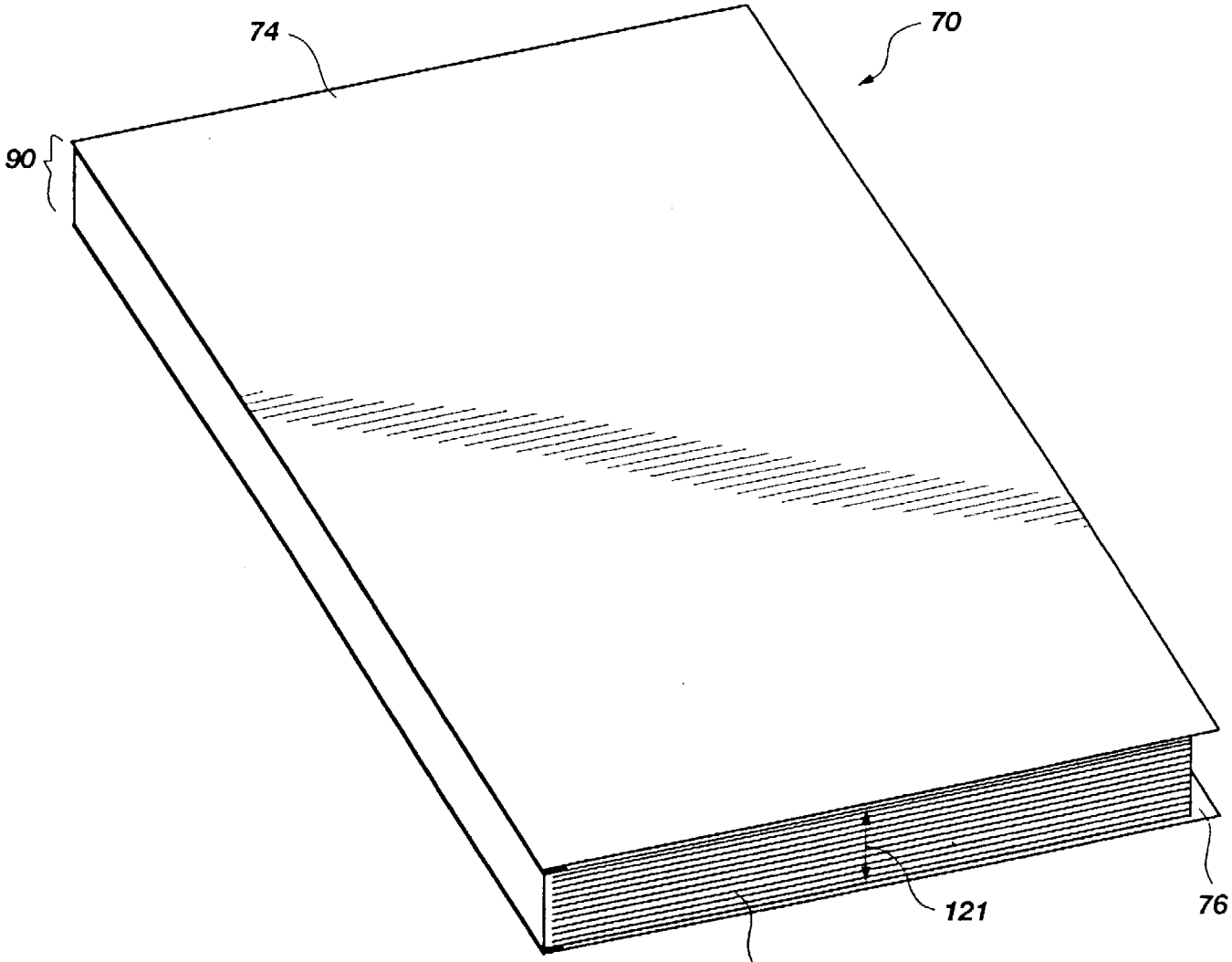
FIG. 3 is a perspective view of the binder of FIG. 2 with documents fully assembled.

The first folding section 83 is connected to the edge 74D of the front cover 74 and extends inwardly 81 therefrom. The first folding section is operable between a first position in which it is open for receiving first fastening means for fastening documents to the first folding section as shown in FIG. 2 and a second position spaced from the first position to restrict visual access to the first fastening means as seen in FIG. 3. The second folding section 85 is similarly connected, but to the edge 76D of the back cover 76, and extends inwardly 81 therefrom. The second folding section is operable between a first position in which it is open for receiving first fastening means which is extending from the first folding section for fastening documents to the second folding section as seen in FIG. 2 and a second position in which visual access to the first fastening means extending to the second folding section 85.

In FIG. 2, it can be seen that a crease 94 is formed between the front cover 74 along edge 74D and a first fold surface or section 82. A first crease 96 is formed between section 82 and the first fastening surface or section 84. A second crease 100 is formed between first fold surface or section 86 and the second fastening surface or section 88. A crease 102 is formed along the edge 76D between back cover 76 and section 88.

In FIG. 2, the expandable section 90 is shown constructed to have a plurality of pleats that extend along the length of the section 90 between the ends 73A and 73B. The pleated material may be likened to material that has a plurality of folds (much like draperies or an accordion). The number of pleats 98 or folds in expandable section 90 is selected to accommodate a particular range of thicknesses 99 of documents that may be positioned in a channel 106 formed between and defined by sections 84 and 86. The documents and sections 84 and 86 may be adhered to and between the first fastening surface 84 and the second fastening surface 86 by fastening means which includes any acceptable means of adherence including staples, thread, cord, posts and screws, clips and clamps, as well as glue. In some conditions, the front cover 74 and the back cover 76 may each be manipulated by pulling on them to expose the first fastening surface 84 and the second fastening surface 86 so that one may proceed with the fastening of the documents in the channel 106. In some cases, one side of a stapler (not shown) may be inserted in a groove 110 created by sections 82 and 84, while the other side of the stapler may be inserted in a groove 112 formed by sections 86 and 88.

An adhesive 118 (shown as dots) is preferably applied to second fold surface or section 88. Alternatively, the adhesive may be applied to section 86. Various adhesives may be used. One preferred adhesive is of the type in which it is preapplied to the first fold surface and then covered with a removable material to protect the adhesive from operation.

When ready, the material is removed and the adhesive becomes operative to secure the second fold surface into the second fastening surface as illustrated in FIG. 3. Various acceptable adhesives have been found which include one marketed by the 3M company (Minnesota Mining & Manufacturing) of Minneapolis, Minn. Alternatively, one may use heat-activated glues. Even a Polystretch™ material may be suitable. The Polystretch™ material is a heat transfer material that is available from Polymark Corporation, 750 Redna Terrace, Cincinnati, Ohio 45215.

The same adhesive (not shown) is preferably applied to section 82 (or alternatively to section 84) and used in the same manner as adhesive 118.

With section 82 adhered to section 84, and section 86 adhered to section 88, staples or other means of adhesion between expandable section 106 and sections 84 and 86 are concealed, thereby providing a pleasing appearance. Also document integrity is more easily maintained because the tendency to remove or take apart is substantially inhibited.

FIG. 3 shows binder 70 with a document 120 between covers 74 and 76. In FIG. 3, binder 70 is in an "assembled" condition with the adhesive operating to secure the first fold surface 82 to the first fastening surface 84 and the second fold surface 86 to the second fastening surface 88. It may be noted that the pleats of the expandable section 90 allow the user the option to select documents 120 of significantly different thicknesses 121 for use with the binder 70. That is, several identical binders 70 may be use for documents of substantially different thicknesses. Thus, a user has greater flexibility in use with a binder of the invention.

Figure 4:
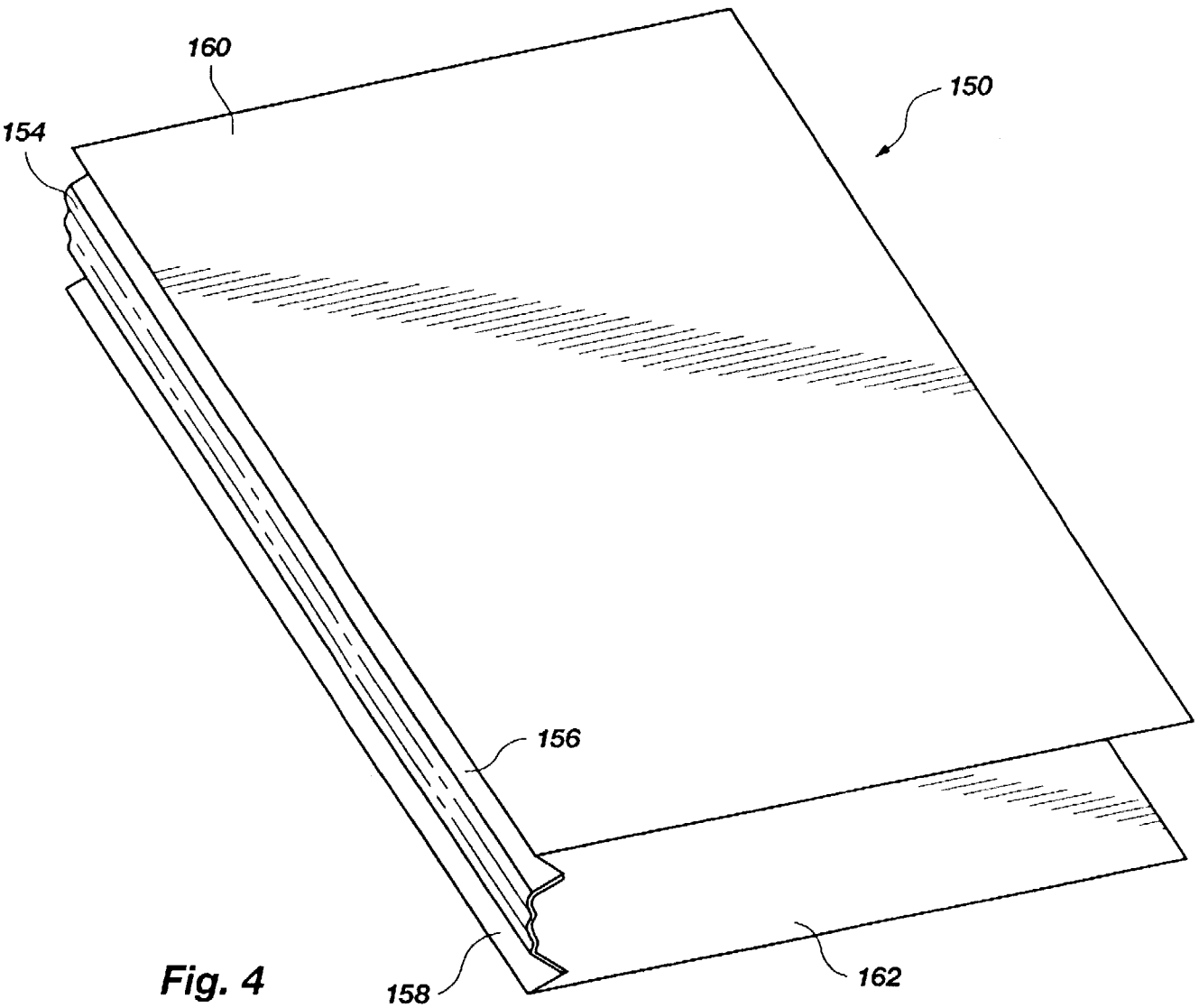
FIG. 4 is a perspective view of an alternate embodiment of the invention.

FIG. 4 shows a binder 150, which is like binder 70 except that expandable section 154 is constructed of an elastic or elastic-like material between a first folding section 156 and a second folding section 158. Various elastic or elastic-like materials may be used. The elastic or elastic-like material may extend all the way to the first folding section 156 and the second folding section 158. In some cases, the elastic-like material may extend all the way to the front cover 160 and back cover 162.

Having thus described in detail preferred embodiments of the present invention, it is to be understood that the invention defined by the appended claims is not to be limited by particular details set forth in the above description as many apparent variations thereof are possible without departing from the spirit or scope thereof.

What is claimed is:

1. A binder for documents comprising:

a first cover having a first edge;

a first folding section connected to said first cover along said first edge, said first folding section having a portion extending inwardly from said first edge, and said first folding section being operable between a first position in which it is open for receiving first fastening means for fastening documents to said first folding section and a second position spaced from said first position to restrict visual access to said first fastening means;

first securing means associated with said first folding section for securing said first folding section in its second position;

a second cover spaced from said first cover, said second cover having a second edge;

a second folding section connected to said second cover along said second edge, said second folding section having a portion extending inwardly from said second edge, and said second folding section being operable between a first position in which it is open for receiving said first fastening means extending from said first folding section for fastening documents to said second folding section and a second position spaced from said first position to restrict visual access to said first fastening means;

second securing means associated with said second folding section for securing said second folding section in its second position; and an expandable section connected to and between said first folding section and said second folding section and spaced therefrom to define a document receiving channel therebetween, said expandable section being operable to extend between a collapsed condition for receiving a first selected quantity of documents and an expanded condition for receiving a second selected quantity of documents which exceeds the first selected quantity of documents.

2. The binder of claim 1, wherein said first folding section has a first crease and a first fold surface extending from said first edge to said first crease and a first fastening surface extending from said first crease to said expandable section.

3. The binder of claim 2, wherein said second folding section has a second crease and a second fold surface extending from said second edge to said second crease and a second fastening surface extending from said first crease to said expandable section.

4. The binder of claim 3, wherein said first securing means is a first adhesive applied to one of said first fold surface and said first fastening surface.

5. The binder of claim 4, wherein said second securing means is a second adhesive applied to one of said second fold surface and said second fastening surface.

6. The binder of claim 5, wherein said first adhesive is of the type that is first applied and then covered with a protective covering and then presented for use upon removal of said protective covering, and wherein said first adhesive is applied to said first fold surface.

7. The binder of claim 6, wherein said second adhesive is of the type that is first applied and then covered with a protective covering and then presented for use upon removal of said protective covering, and wherein said first adhesive is applied to said first fold surface.

8. The binder of claim 5, wherein said first adhesive and said second adhesive are a heat transfer material which become operative as an adhesive upon application of heat thereto.

9. The binder of claim 3, wherein said first cover and said second cover are shaped to cover selected documents positioned in said channel.

10. The binder of claim 3, wherein said first fastening means includes apertures formed in said first fastening surface, said second fastening surface and the documents to be positioned in said channel and post mechanisms positionable through said apertures to secure said documents between said first fastening surface and said second fastening surface and proximate said expandable section.

11. The binder of claim 3, wherein said first fastening surface and said second fastening surface are each made of a material through which staples may be inserted, and wherein said first fastening means includes staples sized to be positionable through said first fastening surface, the documents to be positioned in said channel and said second fastening surface.

12. The binder of claim 3, wherein said expandable section is made of a non-woven material.

13. The binder of claim 12, wherein said expandable section has a plurality of pleats each having creases which each extend generally in alignment with said first edge and said second edge.

14. The binder of claim 3, wherein said first edge and said second edge are substantially straight and in substantial alignment, wherein said first crease and said second crease are substantially straight and in substantial alignment.

15. The binder of claim 4, wherein said expandable section has an interior and an exterior, and wherein said interior has an adhesive to adhere the documents thereto in said channel.

16. The binder of claim 4, wherein said first folding section is formed to be substantially "V"-shaped with said first crease spaced inwardly from said expandable section.

17. The binder of claim 16, wherein said second folding section is formed to be substantially "V"-shaped with said second crease spaced inwardly from said expandable section.

18. A binder for documents comprising:

a first cover having a first edge;

a first folding section connected to said first cover along said first edge, said first folding section having a portion extending inwardly from said first edge, and said first folding section being operable between a first position in which it is open for receiving first fastening means for fastening documents to said first folding section and a second position spaced from said first position to restrict visual access to said first fastening means;

first securing means associated with said first folding section for securing said first folding section in its second position;

a second cover spaced from said first cover, said second cover having a second edge;

a second folding section connected to said second cover along said second edge, said second folding section having a portion extending inwardly from said second edge, and said second folding section being operable between a first position in which it is open for receiving second fastening means for fastening documents to said second folding section and a second position spaced from said first position to restrict visual access to said second fastening means;

second securing means associated with said second folding section for securing said second folding section in its second position; and an expandable section connected to and between said first folding section and said second folding section and spaced therefrom to define a document receiving channel therebetween, said expandable section being operable to extend between a collapsed condition for receiving a first selected quantity of documents and an expanded condition for receiving a second selected quantity of documents which exceeds the first selected quantity of documents.

19. The binder of claim 18, wherein said first fastening means and said second fastening means are staples.

20. A method of assembling a plurality of documents, said method comprising: providing a binder having:

a first cover having a first edge, a first folding section connected to said first cover along said first edge, said first folding section having a first crease and a first fold surface extending from said first edge to said first crease and a first fastening surface extending away from said first crease, and said first folding section being operable between a first position in which it is open for receiving first fastening means for fastening documents to said first folding section and a second position spaced from said first position to restrict visual access to said first fastening means, first securing means associated with said first folding section for securing said first folding section in its second position, a second cover spaced from said first cover, said second cover having a second edge, a second folding section connected to said second cover along said second edge, said second folding section having a second crease and a second fold surface extending from said second edge to said second crease and a second fastening surface extending from said second crease, and said second folding section being operable between a first position in which it is open for receiving said first fastening means extending from said first folding section for fastening documents to said second folding section and a second position spaced from said first position to restrict visual access to said second fastening means, second securing means associated with said second folding section for securing said second folding section in its second position; and an expandable section connected to and between said first folding section and said second folding section and spaced therefrom to define a document receiving channel therebetween, said expandable section being operable to extend between a collapsed condition for receiving a first selected quantity of documents and an expanded condition for receiving a second selected quantity of documents which exceeds the first selected quantity of documents;

positioning documents between said first cover and said second cover, each of said documents having an edge positioned proximate said expandable section and in said channel;

manipulating said first cover to move said first fold surface and expose said first fastening surface;

manipulating said second cover to move said second fold surface and expose said second fastening surface;

position fastening means through said first fastening surface and said documents and into said second fastening surface;

manipulating said first cover to position said first fold surface proximate said first fastening surface and adhere said first fold surface to said first fastening surface; and manipulating said second cover to position said second fold surface proximate said second fastening surface and adhere said second fold surface to said second fastening surface.

* * * * *